US010512579B1

(12) United States Patent
Michaud

(10) Patent No.: US 10,512,579 B1
(45) Date of Patent: Dec. 24, 2019

(54) HOURGLASS URN

(71) Applicant: Raymond Michaud, Gilford, NH (US)

(72) Inventor: Raymond Michaud, Gilford, NH (US)

( * ) Notice: Subject to any disclaimer, the term of this patent is extended or adjusted under 35 U.S.C. 154(b) by 0 days.

(21) Appl. No.: 16/372,531

(22) Filed: Apr. 2, 2019

(51) Int. Cl.
*A61G 17/08* (2006.01)
*G04F 1/06* (2006.01)
*A61G 17/007* (2006.01)

(52) U.S. Cl.
CPC ..... *A61G 17/08* (2013.01); *A61G 17/0166* (2017.05); *G04F 1/06* (2013.01)

(58) Field of Classification Search
CPC ..... A61G 17/08; A61G 17/0166; G06F 1/06; G06F 47/00; G06F 7/00; G04F 1/06; G04F 7/00; G04B 47/00
USPC ..... 27/1; 368/10, 93, 95
See application file for complete search history.

(56) References Cited

U.S. PATENT DOCUMENTS 6,044,532 A * 4/2000 Bowling ..... A61G 17/08 108/139
6,579,003 B2 6/2003 Glick
7,174,611 B1 2/2007 Rose
D633,685 S 3/2011 Caffee
8,627,555 B2 1/2014 Kennedy
2007/0104033 A1* 5/2007 Tsai ..... G04F 1/06 368/93
2008/0264882 A1* 10/2008 Sviberg-Krahner ... A61G 17/08 211/85.27
2009/0185454 A1 7/2009 Allen
2012/0136133 A1 5/2012 Shimizu
2012/0163133 A1* 6/2012 Gonzales ..... G04B 47/00 368/10

* cited by examiner

*Primary Examiner* — William L Miller

(57) ABSTRACT

The hourglass urn is a commemorative ornament for housing ashes which are remains of a loved one. The hourglass urn may comprise an hourglass that functions as an interval timer. The remains of a loved one may be visible within the bulb of the hourglass. The hourglass urn may comprise a left support pillar and a right support pillar that couple to the top of a base. The base may comprise a plaque having an inscription to commemorate the loved one. The left and right support pillars may support a yoke that is free to rotate in apertures at the top of the left and right support pillars. The yoke may support an hourglass-shaped bulb that holds the ashes.

11 Claims, 4 Drawing Sheets

HOURGLASS URN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of funerary urns and memorials, more specifically, an hourglass urn.

SUMMARY OF INVENTION

The hourglass urn is a commemorative ornament for housing ashes which are remains of a loved one. The hourglass urn may comprise an hourglass that functions as an interval timer. The remains of a loved one may be visible within the bulb of the hourglass. The hourglass urn may comprise a left support pillar and a right support pillar that couple to the top of a base. The base may comprise a plaque having an inscription to commemorate the loved one. The left and right support pillars may support a yoke that is free to rotate in apertures at the top of the left and right support pillars. The yoke may support an hourglass-shaped bulb that holds the ashes.

An object of the invention is to hold ashes which are the remains of a loved one.

Another object of the invention is to provide a functioning hourglass to hold the ashes.

A further object of the invention is to provide a plaque bearing a commemorative inscription.

Yet another object of the invention is to protect the plaque from scuffs and scratches by placing it within an offset of the base.

These together with additional objects, features and advantages of the hourglass urn will be readily apparent to those of ordinary skill in the art upon reading the following detailed description of the presently preferred, but nonetheless illustrative, embodiments when taken in conjunction with the accompanying drawings.

In this respect, before explaining the current embodiments of the hourglass urn in detail, it is to be understood that the hourglass urn is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hourglass urn.

It is therefore important that the claims be regarded as including such equivalent construction insofar as they do not depart from the spirit and scope of the hourglass urn. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
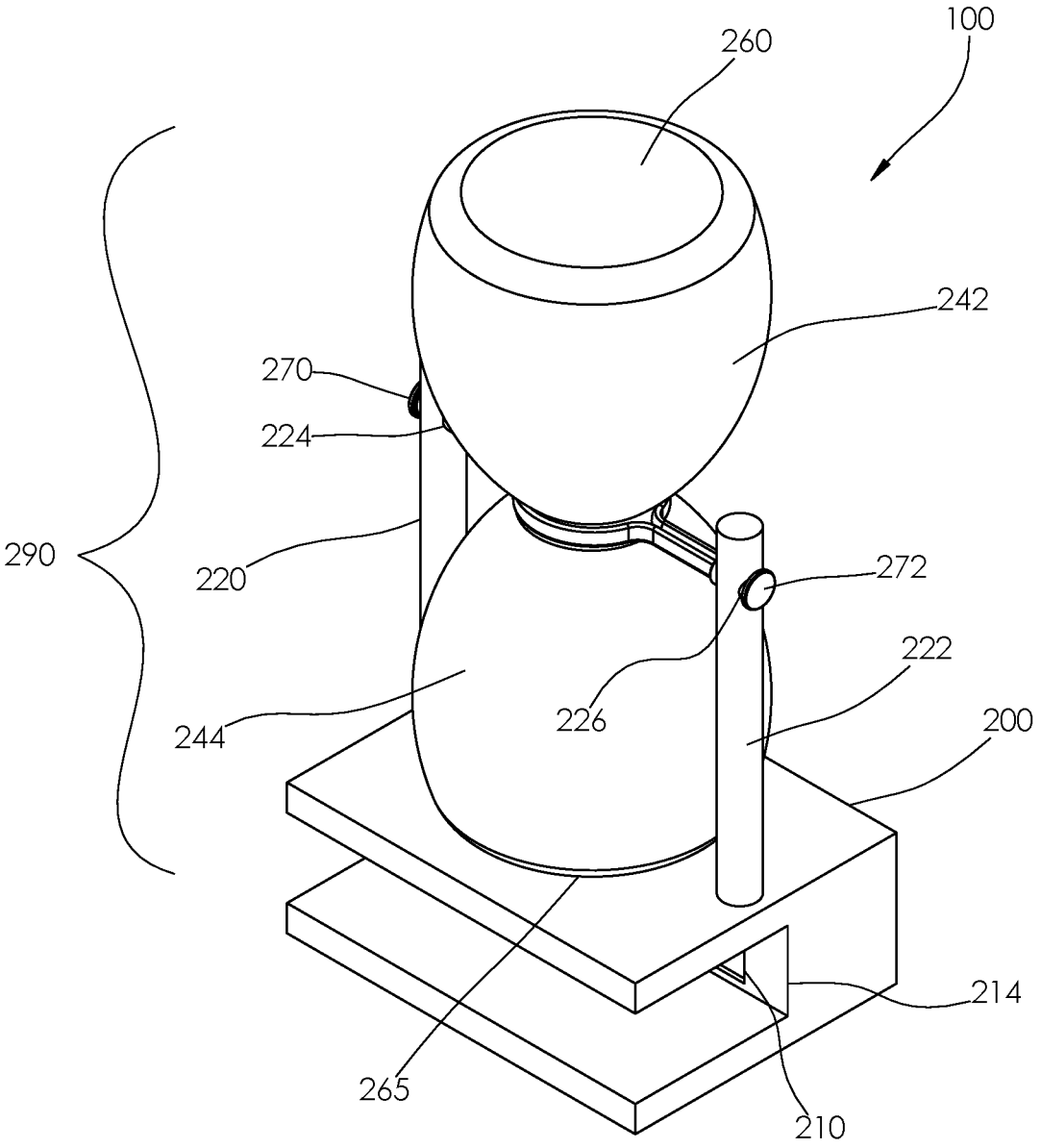
FIG. 1 is a perspective view of an embodiment of the disclosure.
Figure 2:
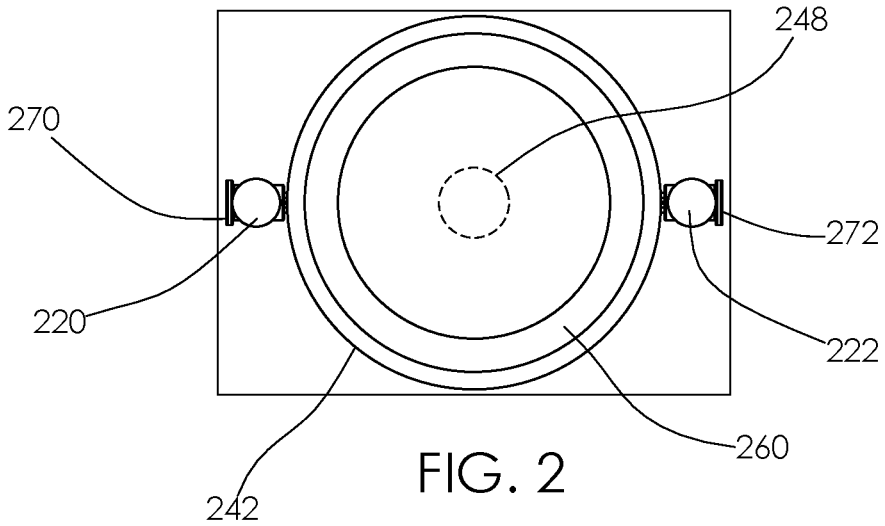
FIG. 2 is a top view of an embodiment of the disclosure.
Figure 3:
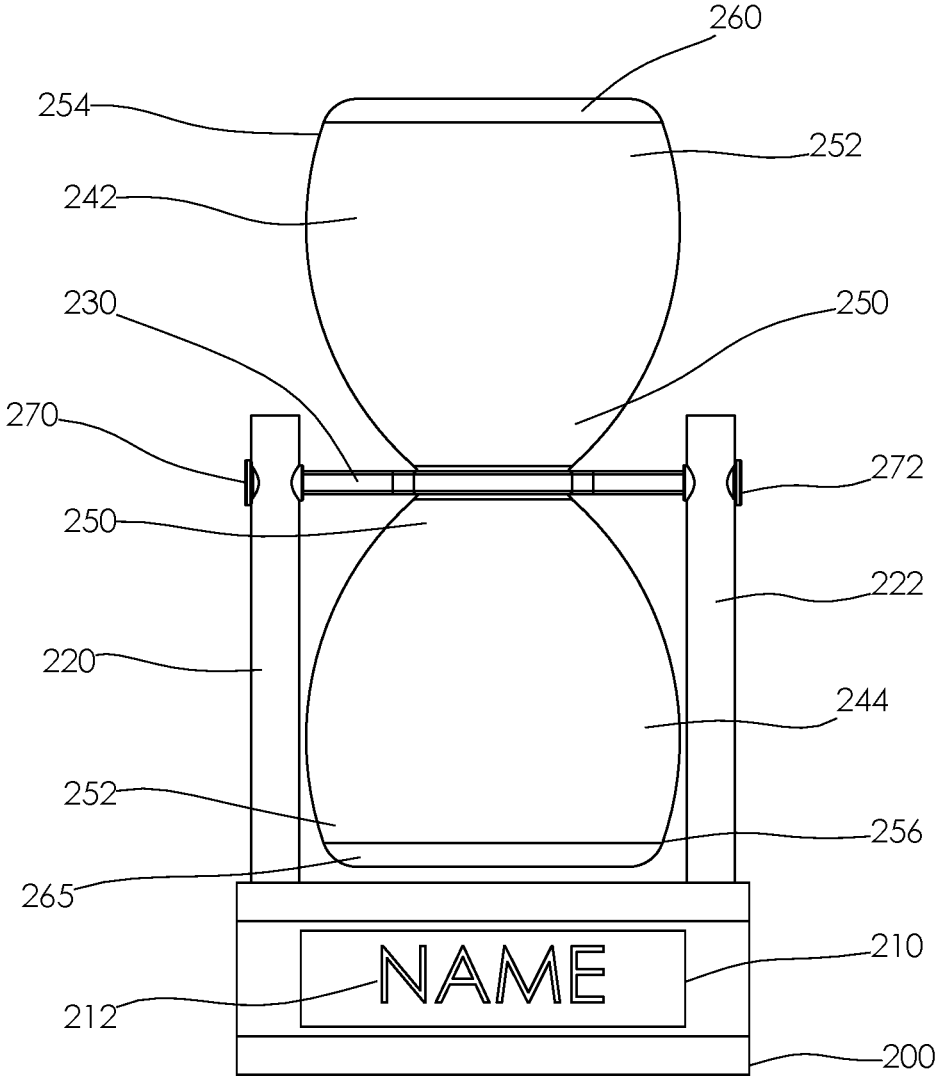
FIG. 3 is a front view of an embodiment of the disclosure.
Figure 4:
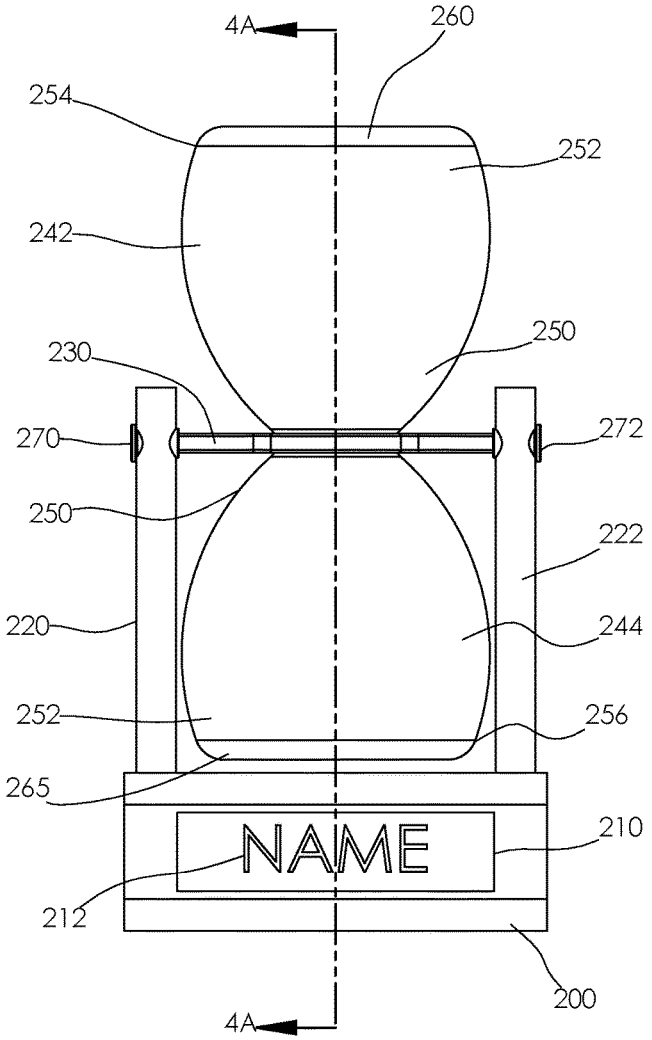
FIG. 4 is a front view of an embodiment of the disclosure.
Figure 4A:
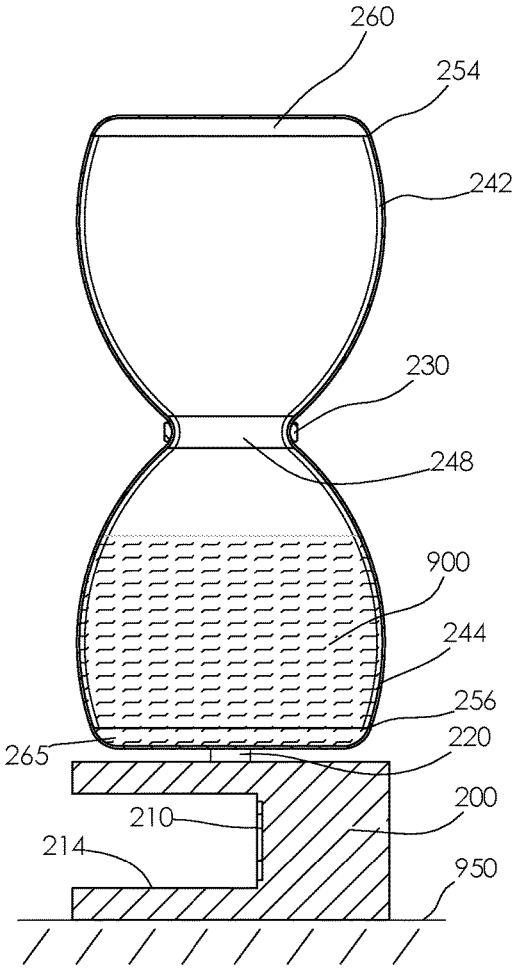
FIG. 4A is a cross-sectional view of an embodiment of the disclosure across 4A-4A as shown in FIG. 4.
Figure 5:
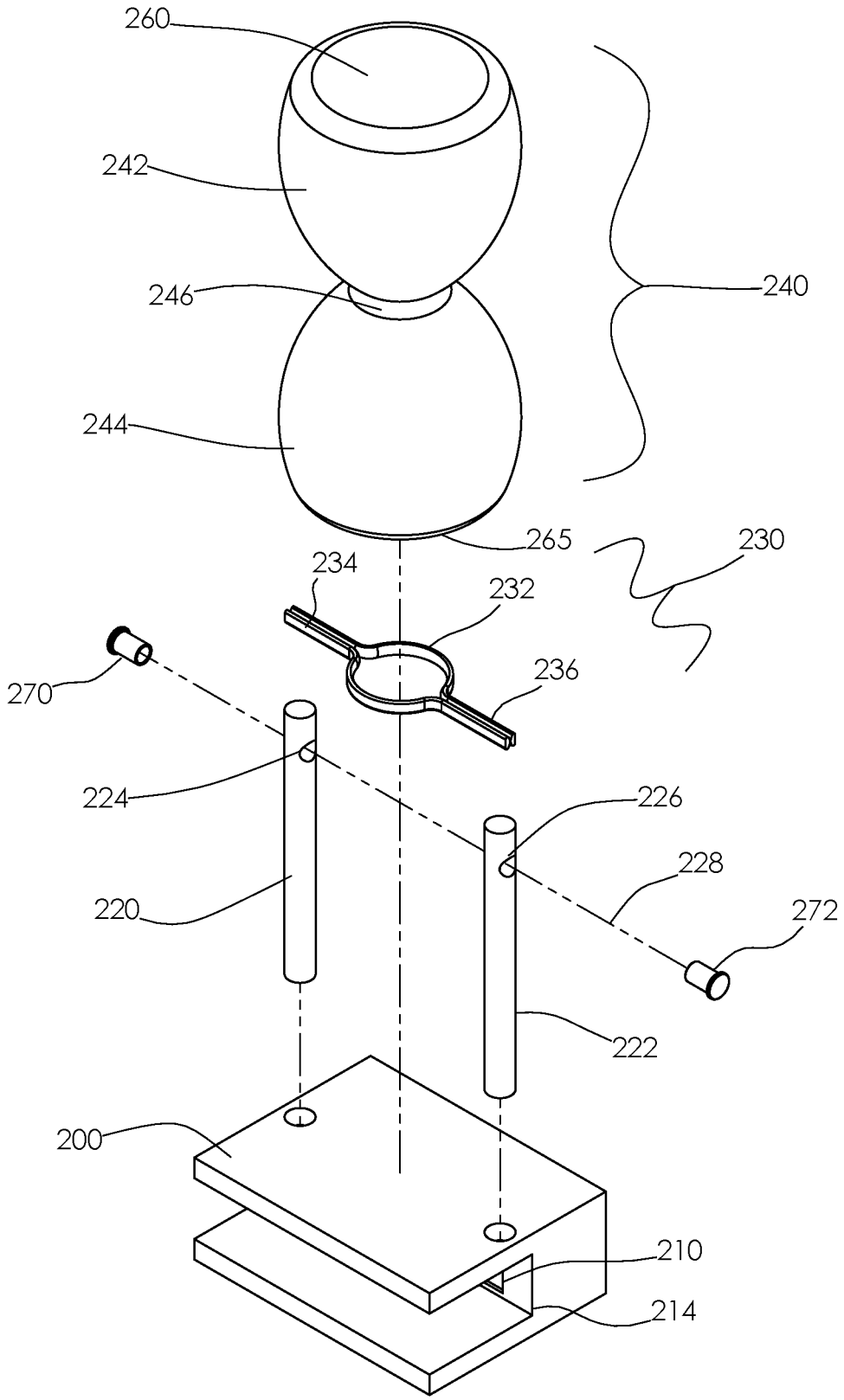
FIG. 5 is an exploded view of an embodiment of the disclosure.

Detailed reference will now be made to a first potential embodiment of the disclosure, which is illustrated in FIGS. 1 through 5.

The hourglass urn 100 (hereinafter invention) comprises a base 200, a left support pillar 220, a right support pillar 222, a yoke 230, and a bulb 240. The invention 100 may be a commemorative ornament for housing ashes 900 which are remains of a loved one. The invention 100 may comprise an hourglass 290 that functions as an interval timer. The remains of a loved one may be visible within the bulb 240 of the hourglass 290.

The base 200 may be a support structure for the hourglass 290. The bottom of the base 200 may rest upon a horizontal surface 950. The weight of the base 200 may lower the center of gravity of the invention 100 and may thus increase the stability of the invention 100. As non-limiting examples, the base 200 may be made from marble, granite, or other stone, aluminum, stainless steel, or other metal, plastic, wood, resin, or combinations thereof. In some embodiments, the base 200 may be the shape of a rectangular prism. The left support pillar 220 and the right support pillar 222 may be coupled to the top of the base 200 and may project vertically upwards from the top of the base 200.

The base 200 may comprise a plaque 210. The plaque 210 may bear an inscription 212. As non-limiting examples, the inscription 212 may be the name of the loved one, age of the loved one, birthdate of the loved one, death date of the loved one, scripture passage, or a combination thereof. In some embodiments, the plaque 210 may be mounted within an inset 214 of the base 200 to protect the plaque 210 from scuffs and scratches.

The left support pillar 220 and the right support pillar 222 may be vertically-oriented armatures that lift the bulb 240 above the base 200 such that the bulb 240 may be inverted without interference from the base 200. The left support pillar 220 may be located on the left side of the bulb 240 and the right support pillar 222 may be located on the right side of the bulb 240.

The yoke 230 may be an armature that holds the bulb 240 above the base 200. The yoke 230 may comprise an annulus 232 that surrounds a neck 246 of the bulb 240. The yoke 230 may comprise a left yoke arm 234 and a right yoke arm 236 that project away from the center of the annulus 232 horizontally and in opposite directions. The left yoke arm 234 and the right yoke arm 236 may comprise an axis for rotating the bulb 240. The left end of the yoke 230 may pass through a left yoke aperture 224 located at the top of the left support pillar 220. The right end of the yoke 230 may pass through a right yoke aperture 226 located at the top of the right support pillar 222. The left yoke aperture 224 and the right yoke aperture 226 may be aligned with each other such that they share a common centerline 228. A left yoke arm cap 270 and a right yoke arm cap 272 may couple to the distal ends of the left yoke arm 234 and the right yoke arm 236, respectively, and may prevent the yoke 230 from sliding laterally.

The bulb 240 may be a clear container for the ashes 900. The bulb 240 may be an hourglass shape—wider at the top and at the bottom and narrower at the neck 246 located at the center. The bulb 240 may be supported by the yoke 230 at the neck 246 and may be inverted by rotating the yoke 230 by 180 degrees.

The bulb 240 may comprise a first bulb half 242 and a second bulb half 244. The first bulb half 242 and the second bulb half 244 may each have a proximal end 250 and a distal end 252. The first bulb half 242 and the second bulb half 244 may be coupled to each other at the proximal ends 250 to form the neck 246. The first bulb half 242 and the second bulb half 244 may each be wider at the distal end 252 than at the proximal end 250. The distal end 252 of the first bulb half 242 and the distal end 252 of the second bulb half 244 may be open so that the ashes 900 may be added to the bulb 240. The distal end 252 of the first bulb half 242 may be sealed at the distal end 252 by a first bulb cap 260. The distal end 252 of the second bulb half 244 may be sealed at the distal end 252 by a second bulb cap 265. The first bulb cap 260, the second bulb cap 265, or both may be removable. As non-limiting examples, the first bulb cap 260 may couple to the first bulb half 242 via a first threaded interface 254 between the first bulb half 242 and the first bulb cap 260 and/or the second bulb cap 265 may couple to the second bulb half 244 via a second threaded interface 256 between the second bulb half 244 and the second bulb cap 265.

The ashes 900 placed into the first bulb half 242 may flow through a neck aperture 248 within the bulb 240 to reach the second bulb half 244. The cross-sectional area of the neck 246 may limit a flow rate at which the ashes 900 may pass through the neck 246. The volume of the ashes 900 placed into the first bulb half 242 and the flow rate of the neck 246 may determine a time interval necessary to empty the ashes 900 from the first bulb half 242 into the second bulb half 244.

The ashes 900 may flow from the second bulb half 244 to the first bulb half 242 via the neck aperture 248 when the hourglass 290 is inverted. Because the volume of the ashes 900 and the cross-sectional area of the neck 246 are the same, the second bulb half 244 takes the time interval to empty into the first bulb half 242. The bulb 240 may time the time interval each time that the bulb 240 is inverted and the ashes 900 are allowed to flow from the top of the bulb 240 to the bottom of the bulb 240. The time interval may be increased by adding more of the ashes 900 to the bulb 240. The time interval may be shortened by removing a portion of the ashes 900 from the bulb 240.

In use, the plaque 210 may be engraved, silkscreened, or otherwise marked with the inscription 212 that commemorates the loved one. The first bulb cap 260 or the second bulb cap 265, whichever is on top, may be removed and the ashes 900 of the loved one may be placed into the bulb 240. The first bulb cap 260 or the second bulb cap 265 may be replaced. The invention 100 may be placed on a shelf, mantle, or other display area as a memorial for the loved one. The bulb 240 may be inverted periodically to measure the time interval. As a non-limiting example, the time interval may be measured as part of a memorial ceremony.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, the "centerline" is an imaginary line that defines the center of multiple cross sections of an object. Unless stated otherwise, the centerline follows a longitudinal path through the object at the center of lateral cross sections. If the object is tubular, the centerline follows the center of the tube.

As used herein, the words "couple", "couples", "coupled" or "coupling", refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point or a central axis of an object and the direction of comparison may be in a radial or lateral direction.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, an "interface" is a physical or virtual boundary that separates two different systems and across which information is exchanged.

As used herein, the words "invert", "inverted", or "inversion" refer to an object that has been turned inside out or upside down or to the act of turning an object inside out or upside down.

As used in this disclosure, the word "lateral" refers to the sides of an object or movement towards a side. Lateral directions are generally perpendicular to longitudinal directions. "Laterally" refers to movement in a lateral direction.

As used herein, the words "printed", "marked", and "marking" refer to a mark that has been made on an object. The process of making the mark may involve printing, lithography, thermal transfer, painting, embossing, molding, burning, silk-screening, drawing, etching, engraving, stamping, spraying of pigments, or other processes which result in the controlled change of coloration and/or shape of a surface.

As used in this disclosure, a "prism" is a 3 dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An hourglass urn comprising:

a base, a left support pillar, a right support pillar, a yoke, and a bulb;

wherein the hourglass urn is a commemorative ornament for housing ashes which are remains of a loved one;

wherein the hourglass urn comprises an hourglass that functions as an interval timer;

wherein the ashes which are remains of a loved one are visible within the bulb of the hourglass;

wherein the base is a support structure for the hourglass;

wherein the bottom of the base rests upon a horizontal surface;

wherein the weight of the base lowers the center of gravity of the hourglass urn and increases the stability of the hourglass urn;

wherein the left support pillar and the right support pillar are coupled to the top of the base and project vertically upwards from the top of the base;

wherein the base comprises a plaque;

wherein the plaque bears an inscription;

wherein the inscription is the name of the loved one, age of the loved one, birthdate of the loved one, death date of the loved one, scripture passage, or a combination thereof;

wherein the plaque is mounted within an inset of the base to protect the plaque from scuffs and scratches;

wherein the left support pillar and the right support pillar are vertically-oriented armatures that lift the bulb above the base such that the bulb is inverted without interference from the base;

wherein the left support pillar is located on the left side of the bulb and the right support pillar is located on the right side of the bulb;

wherein the yoke is an armature that holds the bulb above the base;

wherein the yoke comprises an annulus that surrounds a neck of the bulb;

wherein the yoke comprises a left yoke arm and a right yoke arm that project away from the center of the annulus horizontally and in opposite directions;

wherein the left yoke arm and the right yoke arm comprise an axis for rotating the bulb;

wherein the left end of the yoke passes through a left yoke aperture located at the top of the left support pillar;

wherein the right end of the yoke passes through a right yoke aperture located at the top of the right support pillar;

wherein the left yoke aperture and the right yoke aperture are aligned with each other such that they share a common centerline.

2. The hourglass urn according to claim 1 wherein the base is made from marble, granite, or other stone, aluminum, stainless steel, or other metal, plastic, wood, resin, or combinations thereof.

3. The hourglass urn according to claim 1 wherein the base is the shape of a rectangular prism.

4. The hourglass urn according to claim 1 wherein a left yoke arm cap and a right yoke arm cap couple to the distal ends of the left yoke arm and the right yoke arm, respectively, and prevent the yoke from sliding laterally.

5. The hourglass urn according to claim 4 wherein the bulb is a clear container for the ashes;

wherein the bulb is an hourglass shape,—wider at the top and at the bottom and narrower at the neck located at the center;

wherein the bulb is supported by the yoke at the neck and is inverted by rotating the yoke by 180 degrees.

6. The hourglass urn according to claim 5 wherein the bulb comprises a first bulb half and a second bulb half;

wherein the first bulb half and the second bulb half each comprise a proximal end and a distal end;

wherein the first bulb half and the second bulb half are coupled to each other at the proximal ends to form the neck;

wherein the first bulb half and the second bulb half are each wider at the distal end than at the proximal end.

7. The hourglass urn according to claim 6 wherein the distal end of the first bulb half and the distal end of the second bulb half are open so that the ashes are added to the bulb;

wherein the distal end of the second bulb half is sealed at the distal end by a second bulb cap;

wherein the second bulb cap is removable.

8. The hourglass urn according to claim 7 wherein a first bulb cap couples to the first bulb half via a first threaded interface between the first bulb half and the first bulb cap and/or the second bulb cap couples to the second bulb half via a second threaded interface between the second bulb half and the second bulb cap.

9. The hourglass urn according to claim 7 wherein the ashes placed into the first bulb half flow through a neck aperture within the bulb to reach the second bulb half;

wherein the cross-sectional area of the neck limits a flow rate at which the ashes pass through the neck;

wherein the volume of the ashes placed into the first bulb half and the flow rate of the neck determine a time interval necessary to empty the ashes from the first bulb half into the second bulb half.

10. The hourglass urn according to claim 9 wherein the ashes flow from the second bulb half to the first bulb half via the neck aperture when the hourglass is inverted;

wherein the second bulb half takes the time interval to empty into the first bulb half;

wherein the bulb times the time interval each time that the bulb is inverted and the ashes are allowed to flow from the top of the bulb to the bottom of the bulb.

11. The hourglass urn according to claim 10 wherein the time interval is increased by adding more of the ashes to the bulb;

wherein the time interval is shortened by removing a portion of the ashes from the bulb.

* * * * *